US011086265B2

(12) United States Patent
Nohara

(10) Patent No.: US 11,086,265 B2
(45) Date of Patent: Aug. 10, 2021

(54) IMAGE FORMING APPARATUS

(71) Applicant: KYOCERA Document Solutions Inc., Osaka (JP)

(72) Inventor: Yuta Nohara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/019,499

(22) Filed: Sep. 14, 2020

(65) Prior Publication Data

US 2021/0080895 A1 Mar. 18, 2021

(30) Foreign Application Priority Data

Sep. 18, 2019 (JP) ..... JP2019-169452

(51) Int. Cl.

| | |
|---|---|
| ***G03G 21/12*** | (2006.01) |
| ***G03G 21/10*** | (2006.01) |
| ***G03G 15/00*** | (2006.01) |
| *G03G 15/08* | (2006.01) |

(52) U.S. Cl.

CPC ..... *G03G 21/12* (2013.01); *G03G 21/105* (2013.01); *G03G 15/086* (2013.01); *G03G 15/6502* (2013.01)

(58) Field of Classification Search

CPC .... G03G 21/12; G03G 21/105; G03G 15/086; G03G 15/6502

USPC ..... 399/358, 360

See application file for complete search history.

(56) References Cited

U.S. PATENT DOCUMENTS 9,316,998 B2 * 4/2016 Imanaka ..... G03G 21/12
2016/0033926 A1 * 2/2016 Shima ..... G03G 15/6502 399/110

FOREIGN PATENT DOCUMENTS

JP H06-202529 A 7/1994

* cited by examiner

*Primary Examiner* — Arlene Heredia

(74) *Attorney, Agent, or Firm* — Studebaker & Brackett PC

(57) ABSTRACT

An image forming apparatus includes a cassette attachment part and a collection side attachment part. To the cassette attachment part, a sheet feeding cassette storing a sheet is detachably attached. The collection side attachment part is disposed adjacent to the cassette attachment part. To the collection side attachment part, a collection container storing a waste toner discharged without transferred on the sheet is detachably attached. The cassette attachment part includes a cassette rail which supports the sheet feeding cassette slidably and a rail holding member which holds the cassette rail. The collection side attachment part includes a displacement sensor which is disposed so as to face the collection container and detects an electrostatic capacity varying in response to an accumulation amount of the waste toner stored in the collection container. The rail holding member is disposed so as to face at least a part of the displacement sensor.

7 Claims, 9 Drawing Sheets

IMAGE FORMING APPARATUS

INCORPORATION BY REFERENCE

This application is based on and claims the benefit of priority from Japanese Patent application No. 2019-169452 filed on Sep. 18, 2019, which is incorporated by reference in its entirety.

TECHNICAL FIELD

The present disclosure relates to an image forming apparatus.

BACKGROUND

The image forming apparatus is provided with a cleaning device which removes a residual toner not transferred to a recording medium, from an image carrier, for example. The cleaning device includes a storage container in which the residual toner is stored, and first and second detection means which detect that an amount of the residual toner in the storage container reaches a predetermined amount. The first and second detection means include two input electrodes disposed separately from each other in the upper-and-lower direction in the storage container, one output electrode disposed between the two input electrodes, a switch switching the two input electrodes, and a detection circuit detecting an electrostatic capacity between one of the input electrodes and the output electrode which are connected to each other via the switch. By switching the two input electrodes with the switch, a state where the storage container is nearly filled up and a state where the storage container is filled up are detected.

However, in the above described image forming apparatus (the cleaning device), because it is necessary to provide the electrodes in the storage container, there is a problem that the configuration of the storage container becomes complicated and the manufacturing cost may be increased. Additionally, because the electrodes in the storage container are necessarily connected to the detection circuit disposed outside the storage container, there is a problem that the configuration of the cleaning device becomes complicated and the manufacturing cost may be increased.

For the above problems, for example, it is considerable that a non-contact type electrostatic capacity sensor is disposed outside the storage container and detects an accumulation amount of the residual toner in the storage container. However, an electrostatic capacity measured by the non-contact type electrostatic capacity sensor is varied in response to a distance between the electrostatic capacity sensor and an object to be detected. Then, if a member disposed near the electrostatic capacity sensor is displaced, the electrostatic capacity sensor does not allow detecting an accurate electrostatic capacity. Thus, when the electrostatic capacity sensor is disposed near a movable member, it becomes impossible to detect an accurate accumulation amount of the residual toner.

By the way, the storage container is often disposed below an image carrier, which is a source for the residual toner, that is, in the lower portion in the image forming apparatus because it receives the falling residual toner. Additionally, in the lower portion in the image forming apparatus, a sheet feeding cassette in which a recording material (a sheet) is stored is often attached detachably. Then, if the storage container is disposed near the attachable and detachable sheet feeding cassette, the non-contact type electrostatic capacity sensor may not detect an accurate accumulation amount of the residual toner in the storage container.

SUMMARY OF THE DISCLOSURE

In accordance with one aspect of the present disclosure, an image forming apparatus performing an image formation by transferring a toner image on a sheet includes a cassette attachment part and a collection side attachment part. To the cassette attachment part, a sheet feeding cassette storing the sheet is detachably attached. The collection side attachment part is disposed adjacent to the cassette attachment part. To the collection side attachment part, a collection container storing a waste toner discharged without transferred on the sheet is detachably attached. The cassette attachment part includes a cassette rail which supports the sheet feeding cassette slidably and a rail holding member which holds the cassette rail. The collection side attachment part includes a displacement sensor which is disposed so as to face the collection container and detects an electrostatic capacity varying in response to an accumulation amount of the waste toner stored in the collection container. The rail holding member is disposed so as to face at least a part of the displacement sensor.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, a preferable embodiment of the present disclosure will be described, "Fr", "Rr", "L", "R", "U" and "D" marked in each figure respectively show "front", "rear", "left", "right", "upper" and "lower". In the specification, although terms showing direction and position are used, these terms are used for convenience of description, and do not limit the technical scope of the present disclosure.

Figure 1:
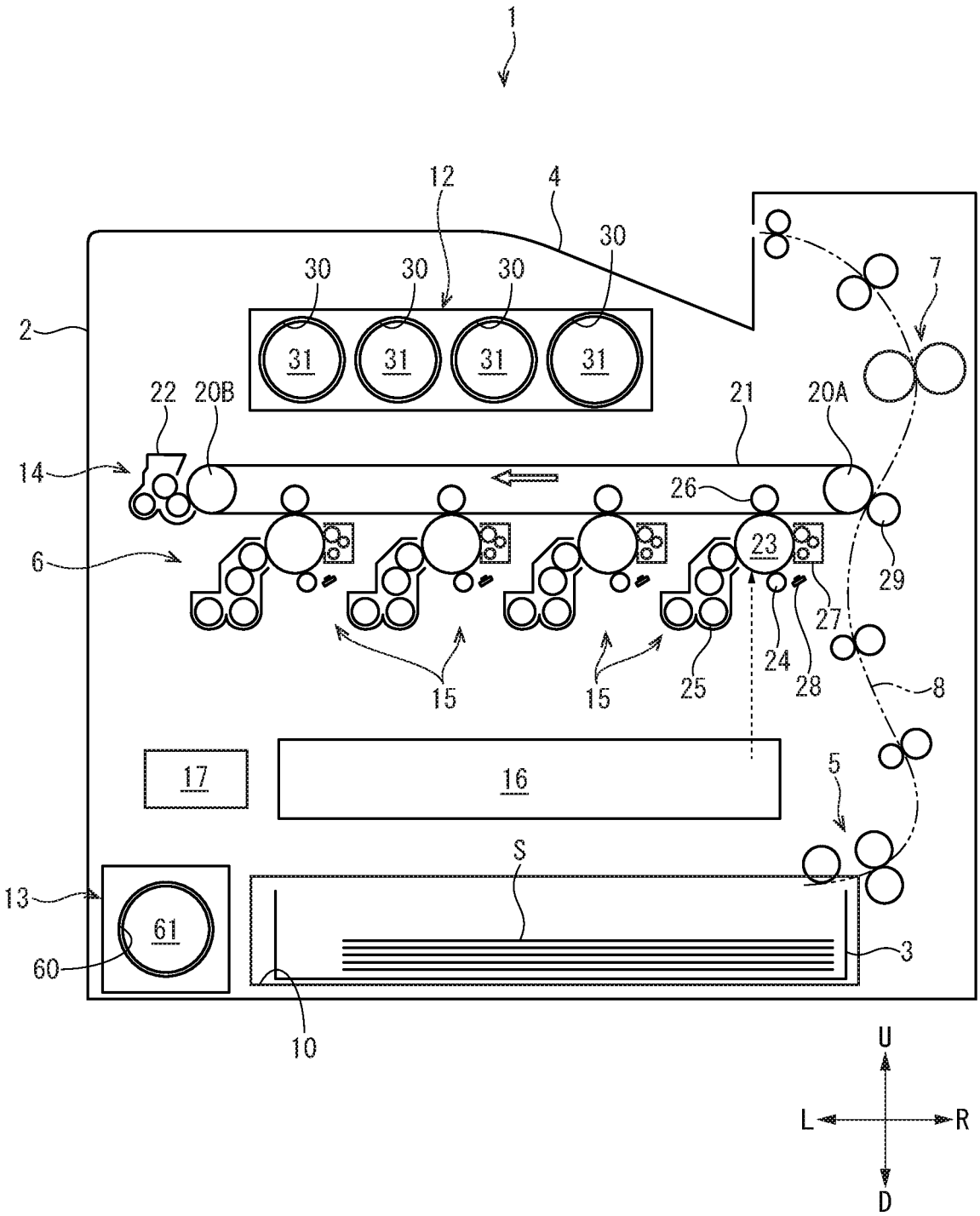
FIG. 1 is a view (a front view) schematically showing an inner structure of an image forming apparatus according to a first embodiment of the present disclosure.
Figure 2:
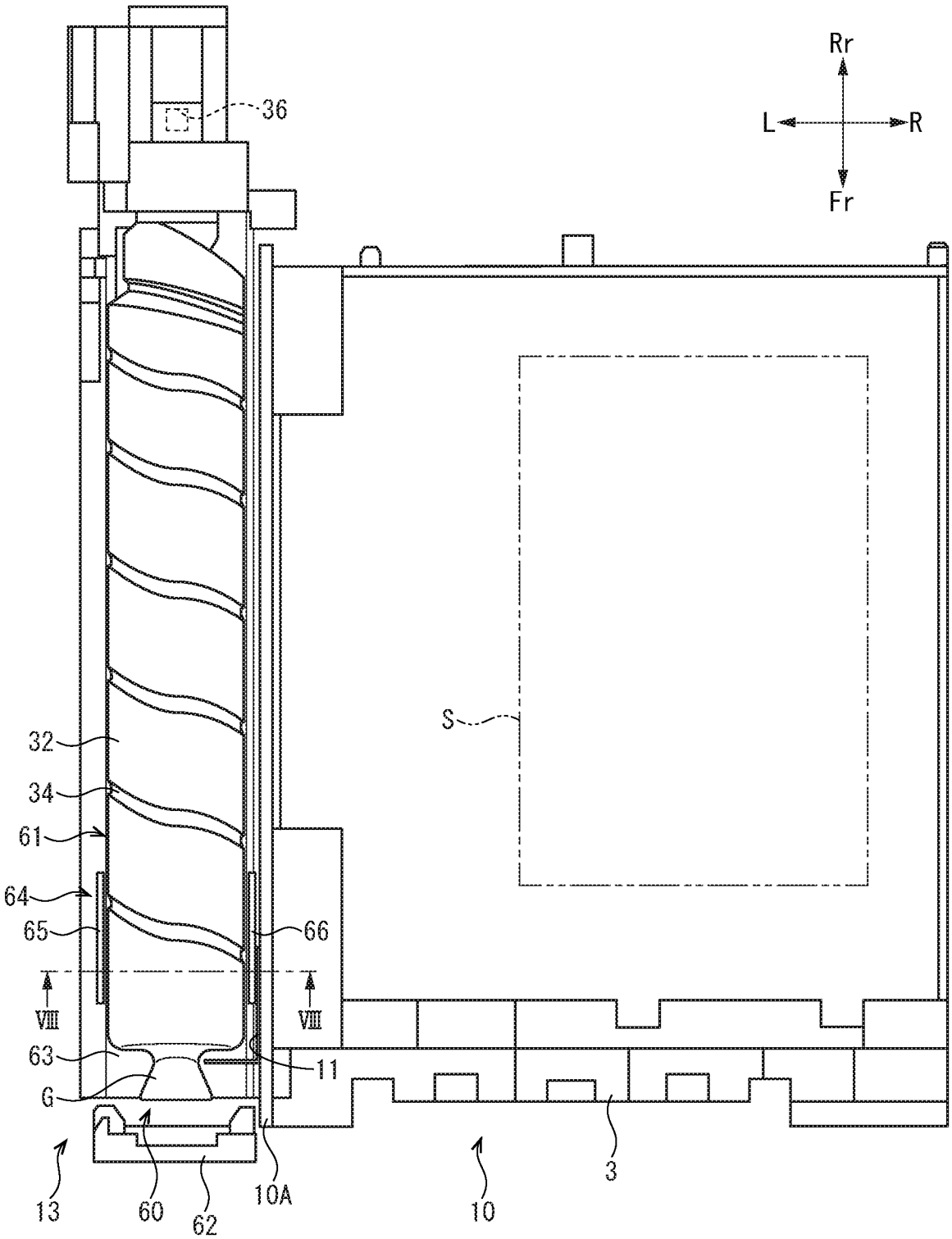
FIG. 2 is a plan view showing a sheet feeding cassette, a waste toner collection device and the others of the image forming apparatus according to the first embodiment of the present disclosure.
Figure 3:
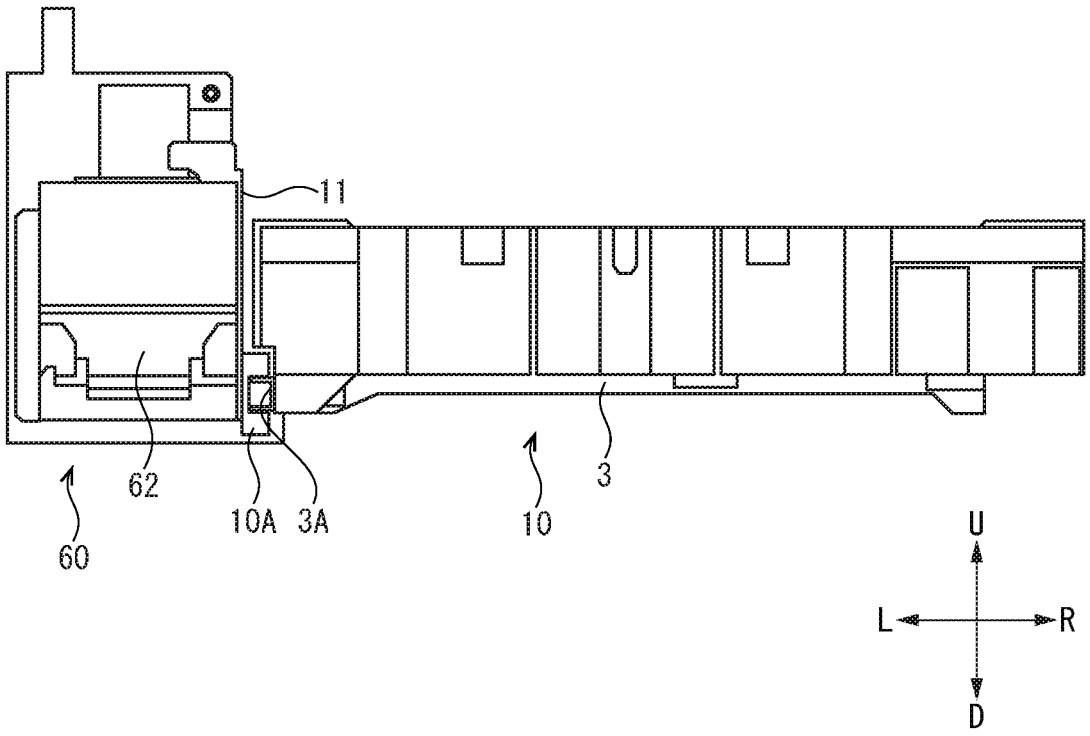
FIG. 3 is a front view showing the sheet feeding cassette, the waste toner collection device and the others of the image forming apparatus according to the first embodiment of the present disclosure.
Figure 4:
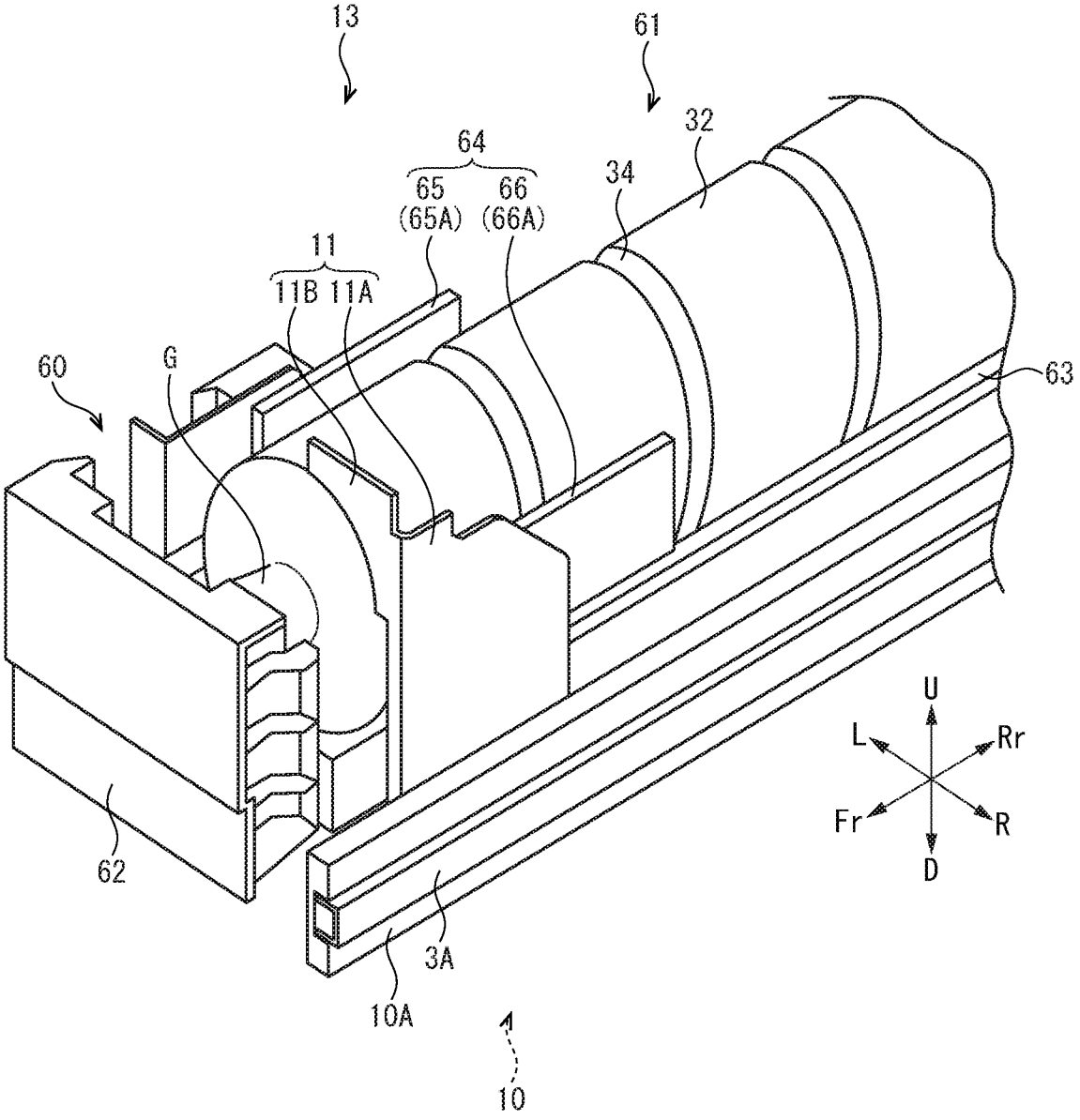
FIG. 4 is a perspective view showing a front portion of the waste toner collection device and its periphery, the waste toner collection device and the others of the image forming apparatus according to the first embodiment of the present disclosure.

[A first embodiment] With reference to FIG. 1 to FIG. 4, the image forming apparatus 1 according to a first embodiment will be described. FIG. 1 is a front view schematically showing an inner structure of the image forming apparatus 1. FIG. 2 is a plan view showing a sheet feeding cassette 3, a waste toner collection device 13 and the others. FIG. 3 is a front view showing the sheet feeding cassette 3, the waste toner collection device 13 and the others. FIG. 4 is a perspective view showing the front portion of the sheet feeding device 3 and its periphery.

[Outline of the image forming apparatus] The image forming apparatus 1 is a color printer 1 performing an image forming by transferring a full color toner image formed by an electrophotographic manner on a sheet S. As shown in FIG. 1, the image forming apparatus 1 includes an apparatus main body 2 constituting an approximately parallelepiped outer appearance. In the lower portion of the apparatus main body 2, a cassette attachment part 10 to which a sheet feeding cassette 3 is attached is provided. The sheet feeding cassette 3 stores a paper sheet S (or a bundle of sheets S), for example. On the upper face of the apparatus main body 2, a discharge tray 3 on which the sheet S with the formed image is received is provided. The sheet S is not limited to the paper sheet, and may be a resin film or a sheet for OHP.

The cassette attachment part 10 has a space in which the sheet feeding cassette 3 is attached. On the lower portion of the front face of the apparatus main body 2, a front opening is formed, through which the sheet feeding cassette 3 is attached and detached to and from the cassette attachment part 10. The sheet feeding cassette 3 is formed into an approximately parallelepiped shape (a box-like shape) whose upper face is opened. The sheet feeding cassette 3 is detachably attached to the cassette attachment part 10.

As shown in FIG. 3 and FIG. 4, on both the left and right side faces of the sheet feeding cassette 3, a pair of slide guides 3A is fixed, and on both the left and right sides of the cassette attachment part 10, a pair of cassette rails 10A is provided (the left side is only shown in FIG. 2 to FIG. 4. The slide guide 3A and the cassette rail 10A are made of metal material, such as stainless steel, for example. The pair of cassette rails 10A holds the pair of slide guides 3A slidably. Thereby, the pair of cassette rails 10A supports the sheet feeding cassette 3 via the pair of slide guides 3A slidably.

On both the left and right sides of the cassette attachment part 10, a pair of rail holding members 11 holding the pair of cassette rails 10A is provided (the left side is only shown in FIG. 2 to FIG. 4). The rail holding member 11 is made of metal material, such as stainless steel, for example. The rail holding member 11 is disposed in the front portion (a portion closer to the front side than the center in the front-and-rear direction) of the cassette attachment part 10. As shown in FIG. 4, the rail holding member 11 has a holding main body 11A provided with an upright posture along the front-and-rear direction and a front face part 11B bent outward from the upper portion of the front end of the holding main body 11A, and forms into an almost L-shape on a plane. The cassette rail 10A is fixed to the holding main body 11A of the rail holding member 11, and the holding main body 11A is fixed to the apparatus main body 2. The lower edge of the front face part 11B is formed into an arc-shape.

As shown in FIG. 1, the image forming apparatus 1 is provided with a sheet feeding part 5, an image forming part 6, a fixing device 7, a toner replenishment device 12 and a waste toner collection device 13 which are stored in the apparatus main body 2. The sheet feeding part 5 is provided at the upstream end portion of a conveyance path extending from the sheet feeding cassette 3 to the discharge tray 4. The fixing device 7 is provided on the downstream portion of the conveyance path 8, and the image forming part 6 is provided on the conveyance path 8 between the sheet feeding device 5 and the fixing device 7. The toner replenishment device 12 is disposed above the image forming part 6. The waste toner collection device 13 is disposed below the image forming part 6.

The image forming part 6 includes an intermediate transferring unit 14, four drum units 15 and an optical scanning device 16. The intermediate transferring unit 14 is disposed below the discharge tray 4. The four drum units 15 are disposed below the intermediate transferring unit 14 side by side in the left-and-right direction. The optical scanning device 16 is disposed below the drum units 15.

The intermediate transferring unit 14 includes an intermediate transferring belt 21 wound around a drive roller 20A disposed in the right portion in the apparatus main body 2 and a driven roller 20B disposed in the left portion in the apparatus main body 2. When the drive roller 20A is driven by a motor (not shown) to be rotated, the intermediate transferring belt 21 is cicurated in a left direction (refer to the arrow in FIG. 1). On a left side of the driven roller 20B, the belt cleaning device 22 is disposed.

The four drum units 15 are provided corresponding to the toners of four colors. Each drum unit 15 includes a photosensitive drum 23, a charging device 24, a development device 25, a primary transferring roller 26, a drum cleaning device 27 and a static eliminator 28. The four drum units 15 have the same configuration, and one of the drum units 15 will be described in the following description.

The photosensitive drum 23 is driven by a motor (not shown) to be rotated while coming into contact with the lower surface of the intermediate transferring belt 21. The charging device 24, the development device 25, the primary transferring roller 26, the drum cleaning device 27 and the static eliminator 28 are disposed around the photosensitive drum 23 in the order of a transferring process. The primary transferring roller 26 is disposed so as to face the photosensitive drum 23 from the upper side across the intermediate transferring belt 21. With the right side portion of the intermediate transferring belt 21 (the drive roller 20A), a secondary transferring roller 29 comes into contact.

As described later in detail, to the toner replenishment device 12, four toner bottles 31 are detachably attached. The four toner bottles 31 store the toners (developers) of the four colors (yellow, magenta, cyan and black) for replenishment. The four tonner bottles 31 are communicated with the respective four development devices 25 through replenishment pipes (not shown) in which a screw is stored, and supplies the replenishment toner to the respective development devices 25. To the waste toner collection device 13, a collection bottle 61 (a collection container) is detachably attached. In the collection bottle 61, a waste toner discharged without being transferred on the sheet S is stored (collected).

The image forming apparatus 1 is provided with a controller 17 to suitably control the devices to be controlled, such as the image forming part 6. The controller 17 contains a processer executing various arithmetic processing according to the program and parameter stored in a memory.

An operation of the image forming apparatus 1 will be described. The controller 17 performs the image forming operation based on an input image data as follows.

The charging device 24 charges the surface of the photosensitive drum 23. The optical scanning unit 16 exposes the photosensitive drum 23 based on the image data to form an electrostatic latent image on the surface of the photosensitive drum 23. The development device 25 develops the electrostatic latent image on the photosensitive drum 23 into a toner image by using the toner supplied from the toner bottle 31 of the toner replenishment device 12. The four colored toner images carried on the surface of the photosensitive drum 23 are primarily transferred on the intermediate transferring belt 21 in order by the primary transferring rollers 26 applied with a primary transferring bias potential. Thereby, a full color toner image is formed on the surface of the intermediate transferring belt 21.

On the other hand, the sheet feeding part 5 feeds the sheet S in the sheet feeding cassette 3 to the conveyance path 8. The secondary transferring roller 29 secondarily transfers the toner image on the intermediate transferring belt 21 to the sheet S passing through the intermediate transferring belt 21 and the secondary transferring roller 29. The fixing device 7 fixes the toner image to the sheet S using heat. Then, the sheet S is discharged on the discharge tray 4. The drum cleaning device 27 removes a waste toner (a residual toner) remaining on the surface of the photosensitive drum 23 after the primary transferring. The static eliminator 28 emits an eraser light to erase the charge remaining on the photosensitive drum 23. The belt cleaning device 22 removes the waste toner remaining on the surface of the intermediate transferring belt 21 after the secondary transferring. The waste toner removed from the photosensitive drum 23 and the intermediate transferring belt 21 is collected in the collection bottle 61 of the waste toner collection device 13.

Figure 5:
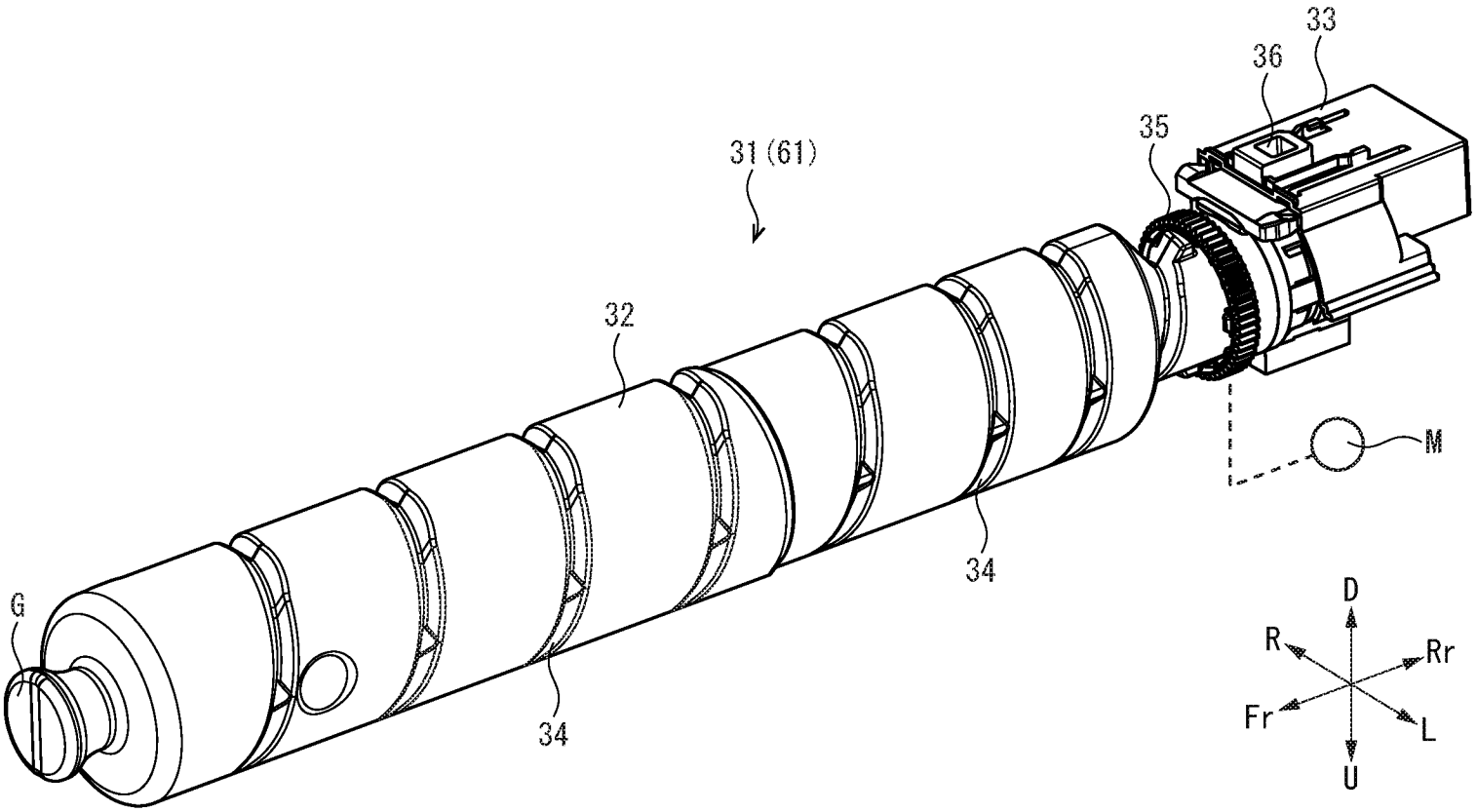
FIG. 5 is a perspective view showing a toner bottle provided in the image forming apparatus according to the first embodiment of the present disclosure.

[The toner replenishment device] Next, with reference to FIG. 1 and FIG. 5, the toner replenishment device 12 will be described. FIG. 5 is a perspective view showing the toner bottle 31.

As shown in FIG. 1, the toner replenishment device 12 is disposed above the intermediate transferring unit 14 (the development devices 25). The toner replenishment device 12 includes four replenishment side attachment parts to which the four toner bottles 31 are detachably attached (inserted). Each replenishment side attachment part 30 has a space to which the toner bottle 31 is attached. On the upper portion of the front face of the apparatus main body 2, a front opening is formed, through which the toner bottle 31 is attached and detached to and from the replenishment side attachment part 30. The replenishment side attachment part 30 includes a replenishment cover (not shown) which opens and closes the front opening.

<The toner bottle> As shown in FIG. 5, each toner bottle 31 includes a container main body 32 and a cap 33. The toner bottle 31 storing the black toner is larger (has a diameter larger) than the other toner bottles 31, and the right end replenishment side attachment part 30 to which the toner bottle 31 storing the black toner is formed to have a diameter larger than the other toner bottles 31 (refer to FIG. 1). The four toner bottles 31 have the same configuration other than their diameters, and one of the toner bottles 31 will be described below. In the following description, the direction is defined based on a state where the toner bottle 31 is attached to the replenishment side attachment part 30. The toner may be a two-component developer containing a toner and a carrier or a one-component developer containing a magnetic toner. The four toner bottles 31 (the four replenishment side attachment parts 30) may have the same size (the diameter).

(The container main body) The container main body 32 is made of synthetic resin such as polyethylene terephthalate (PET), and formed into an approximately cylindrical shape long in the front-and-rear direction. A spiral conveyance rib 34 is formed integrally with the container main body 32 so as to protrude from the outer circumferential face inward in the radial direction (toward the axial center). The container main body 32 and the conveyance rib 34 have almost the same thickness. On the front end face of the container main body 2, a grip part G gripped by a user is protruded. The rear portion of the container main body 32 is formed to be narrower than the other portion, and the rear end face of the container main body 32 is opened (not shown). To the rear portion (the narrowed portion) of the container main body 32, an approximately annular transmission gear 35 is fixed. The transmission gear 35 is connected to a drive motor M via a drive force transmission mechanism (not shown) containing a shaft and a gear. As described later in detail, the container main body 32 is driven by the motor M to be rotated around the axis, and the conveyance rib 34 is rotated together with the container main body 32 to apply conveyance force along the axial direction on the toner in the container main body 32. The conveyance rib 34 is formed integrally with the container main body 32, but not limited thereto, the conveyance rib and the container main body may be formed by separate members (the example is not shown).

(The cap) The cap 33 is disposed on a rear side of the transmission gear 35, and attached to the container main body 32 so as to cover the rear end face (the opening) of the container main body 32. The cap 33 supports the rear end portion (the end portion in the axial direction) of the container main body 32 so as to be rotatable around the axis. The cap 33 has a communication port 36 communicated with an inside of the container main body 32. The communication port 36 is an approximately rectangular hole formed on the lower side face of the cap 33. To the cap 33, a skitter (not shown) to open and close the communication port 36 is provided so as to be slidable in the axial direction (the front-and-rear direction). In a state where the toner bottle 31 is detached from the replenishment side attachment part 30, the shutter closes the communication port 36.

[Attachment of the tone bottle] A process to attach the toner bottle 31 to the replenishment side attachment part 30 will be described. The user opens the replenishment cover of the replenishment side attachment part 30 to expose the front opening, and then inserts the toner bottle 31 with the grip part G forward and the communication port 36 downward into the replenishment side attachment part 30 (through the front opening). On a middle of the insertion of the toner bottle 31, the shutter comes into contact with a part of the replenishment side attachment part 30 and is relatively slid forward relative to the replenishment side attachment part 30 to open the communication port 36. The opened communication port 36 is communicated with the upstream end of the replenishment pipe. Then, the user closes the replenishment cover.

In the above manner, the attachment of the toner bottle 31 is completed. In the state, the replenishment side attachment part 30 supports the cap 33 non-rotatably and the container main body 32 rotatably. Additionally, in the state, the transmission gear 35 is coupled with the drive motor M via the drive force transmission mechanism, and the communication port 36 is communicated with the development device 25 via the replenishment pipe or the others.

When the drive motor M is driven according to a toner replenishment instruction from the controller 17, the container main body 32 is rotated around the axis together with the transmission gear 35. The container main body 32 (the conveyance rib 34) attached to the replenishment side attachment part 30 is rotated around the axis, and the replenishment toner stored in the container main body 32 is conveyed toward the communication port 36. The toner is supplied (replenished) from the communication port 36 to the development device 25 through the replenishment pipe.

In the replenishment side attachment part 30, a remaining amount detection sensor (an electrostatic capacity sensor or the line) to detect an amount of the toner stored in the toner bottle 31 is provided (not shown). The remaining amount detection sensor is disposed so as to face the toner bottle 31 attached to the replenishment side attachment part 30, and measures an electrostatic capacity in response to a remaining amount of the toner. The controller 17 determines that the toner bottle empties (or an amount of the toner is decreased) based on the detection result of the remaining amount detection sensor, and then displays a message showing the empty of the toner bottle or a message for prompting the replacement of the toner bottle on a touch panel (not shown) provided in the image forming apparatus 1. In a case where the empty toner bottle (or the toner bottle storing a decreased amount of the toner) is replaced, the user grips the grip part G to pull the toner bottle 3 forward and to detach the toner bottle 31 from the replenishment side attachment part 30. As the toner bottle 31 is pulled forward, the shutter is biased rearward by a spring (not shown) to close the communication port 36.

Figure 6:
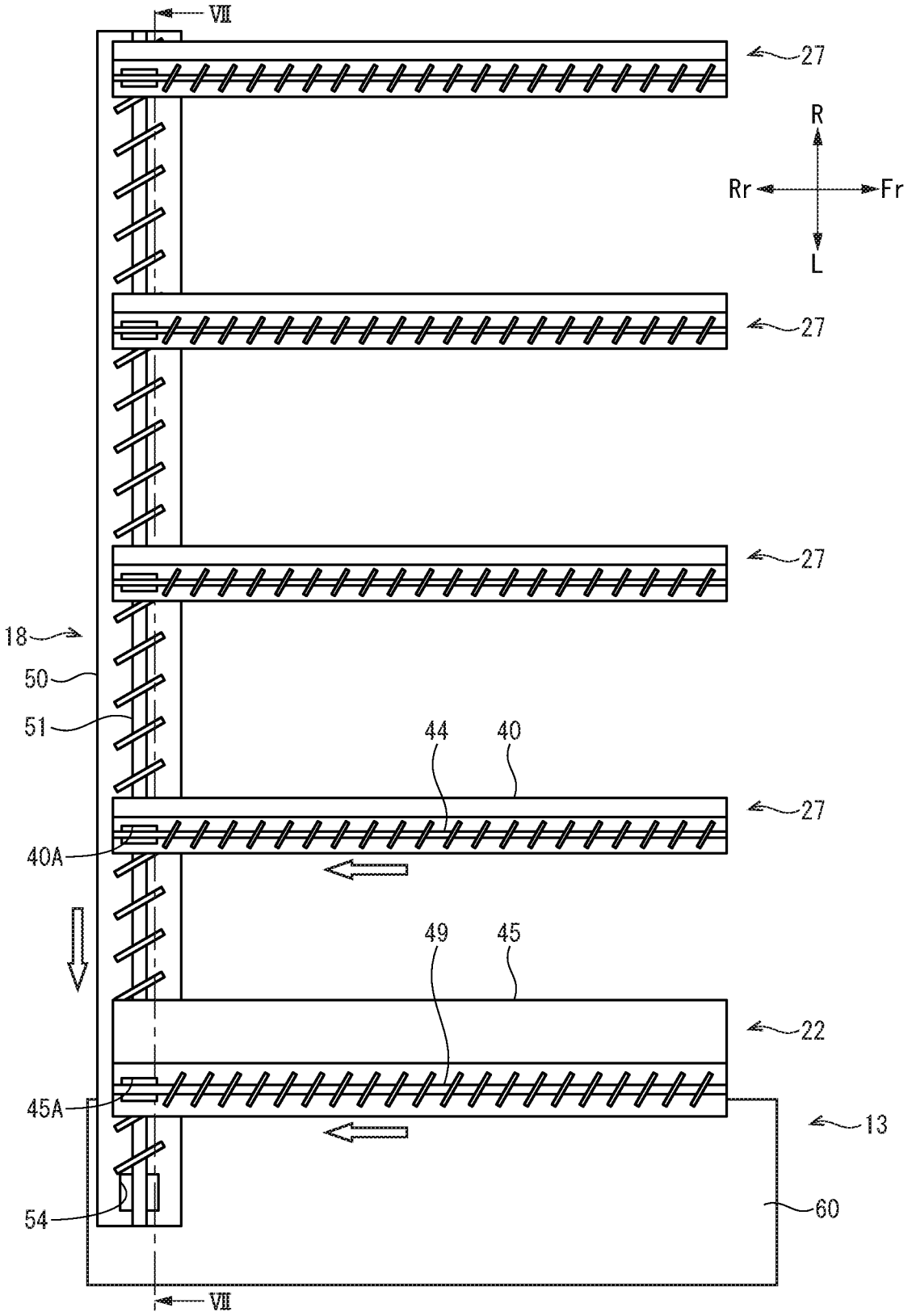
FIG. 6 is a view (a sectional view on a plane) schematically showing a drum cleaning device, a belt cleaning device and a discharge conveyance device of the image forming apparatus according to the first embodiment of the present disclosure.
Figure 7:
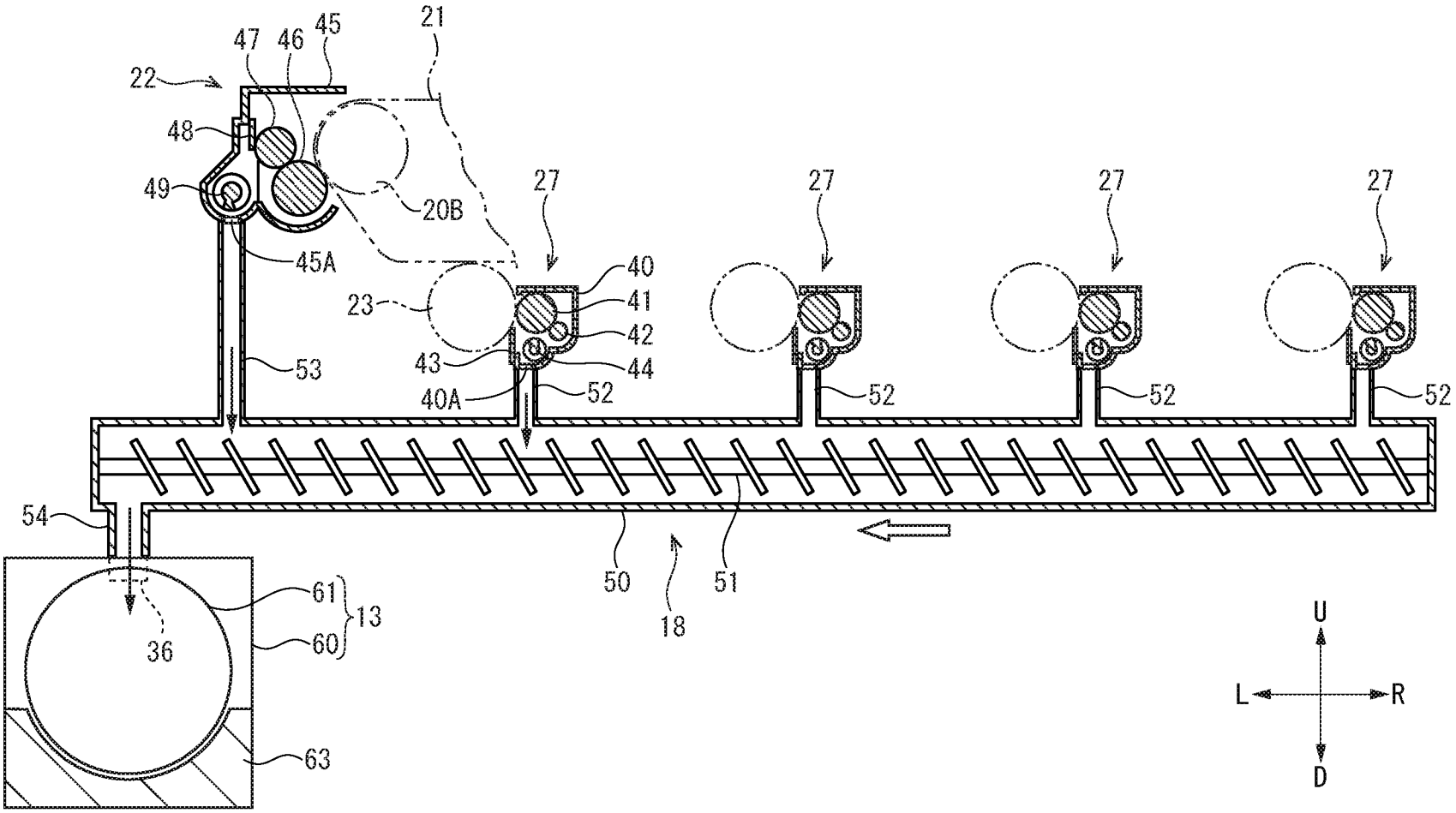
FIG. 7 is a sectional view taken along the line VII-VII in FIG. 6.

Next, with reference to FIG. 6 and FIG. 7, the four drum cleaning devices 27 and the belt cleaning device 22 will be described. FIG. 6 is a view (a sectional view on a plane) schematically showing the drum cleaning device 27, the belt cleaning device 22 and the discharge conveyance device 18. FIG. 7 is a sectional view taken along the line VII-VII in FIG. 6.

[The drum cleaning device] The four drum cleaning devices 27 are provided corresponding to the four photosensitive drums 23 (refer to FIG. 1). The four drum cleaning devices 27 have the same configuration, and one of the drum cleaning devices 27 will be described below.

As shown in FIG. 7, the drum cleaning device 27 includes a drum side housing 40, a polishing roller 41, a regulation roller 42, a cleaning blade 43 and a drum side screw 44.

As shown in FIG. 6 and FIG. 7, the drum side housing 40 is formed into an approximately box-like shape in which a face facing the photosensitive drum 23 is opened. In the rear portion of the bottom face of the drum side housing 40, a drum side discharge port 40A is opened, which is connected to the discharge conveyance device 18 described later. The polishing roller 41 and the regulation roller 42 are each formed into an approximately cylindrical shape long in the front-and-rear direction, and supported in the drum side housing 40 rotatably around an axis. The polishing roller 41 comes into contact with the photosensitive drum 23 and the regulation roller 42 comes into contact with the right lower portion of the polishing roller 41. The cleaning blade 43 is made of synthetic resin, for example, and formed into a plate shape. The cleaning blade 43 is fixed to the drum side housing 40. The tip end portion of the cleaning blade 43 comes into contact with the photosensitive drum 23. The drum side screw 44 includes a spiral blade fixed around a circumferential face of a shaft extending in the front-and-rear direction, and is supported in the drum side housing 40 rotatably around an axis. The drum side screw 44 is disposed in the left lower portion in the drum side housing 40.

[The belt cleaning device] As shown in FIG. 7, the belt cleaning device 22 includes a belt side housing 45, a bias brush 46, a collection roller 47, a collection blade 48 and a belt side screw 49.

As shown in FIG. 6 and FIG. 7, the belt side housing 45 is formed into a box-like shape in which a face facing the intermediate transferring belt 21 is opened. In the rear portion of the bottom face of the belt side housing 45, a belt side discharge port 45A is opened, which is communicated with the discharge conveyance device 18 described later. The bias brush 46 and the collection roller 47 is each formed into an approximately cylindrical shape long in the front-and-rear direction, and supported in the belt side housing 45 rotatably around an axis. The bias brush 46 comes into contact with the intermediate transferring belt 21 and the collection roller 47 comes into contact with the left upper portion of the bias brush 46. The collection blade 48 is made of synthetic resin, for example, and formed into a plate shape. The collection blade 48 is fixed to the belt side housing 45. The tip end portion of the collection blade 48 comes into contact with the collection roller 47. The belt side screw 49 includes a spiral blade fixed around a circumferential face of a shaft extending in the front-and-rear direction, and is supported in the belt side housing 45 rotatably around an axis. The belt side screw 49 is disposed in the left lower portion in the belt side housing 45.

[The discharge conveyance device] As shown in FIG. 6 and FIG. 7, the four drum cleaning devices 27 and the belt cleaning device 22 are connected to the discharge conveyance device 18 which conveys the waste toner toward the waste toner collection device 13. The discharge conveyance device 18 includes a conveyance housing 50 and a conveyance screw 51.

The conveyance housing 50 is formed into an approximately parallelepiped shape long in the left-and-right direction. On the upper face of the conveyance housing 50, four drum side introduction pipes 52 and a belt side introduction pipe 53 are provided side by side in the left-and-right direction. Each drum side introduction pipe 52 is connected to the drum side discharge port 40A of the drum cleaning device 27. The belt side introduction pipe 53 is connected to the belt side discharge port 45A of the belt cleaning device 22. On the left portion of the bottom face of the conveyance housing 50, a conveyance discharge pipe 54 is formed, which is connected to the waste toner collection device 13. The conveyance screw 51 has a spiral blade fixed around a circumferential face of a shaft extending in the left-and-right direction, and is supported in the conveyance housing 50 rotatably around an axis.

Figure 8:
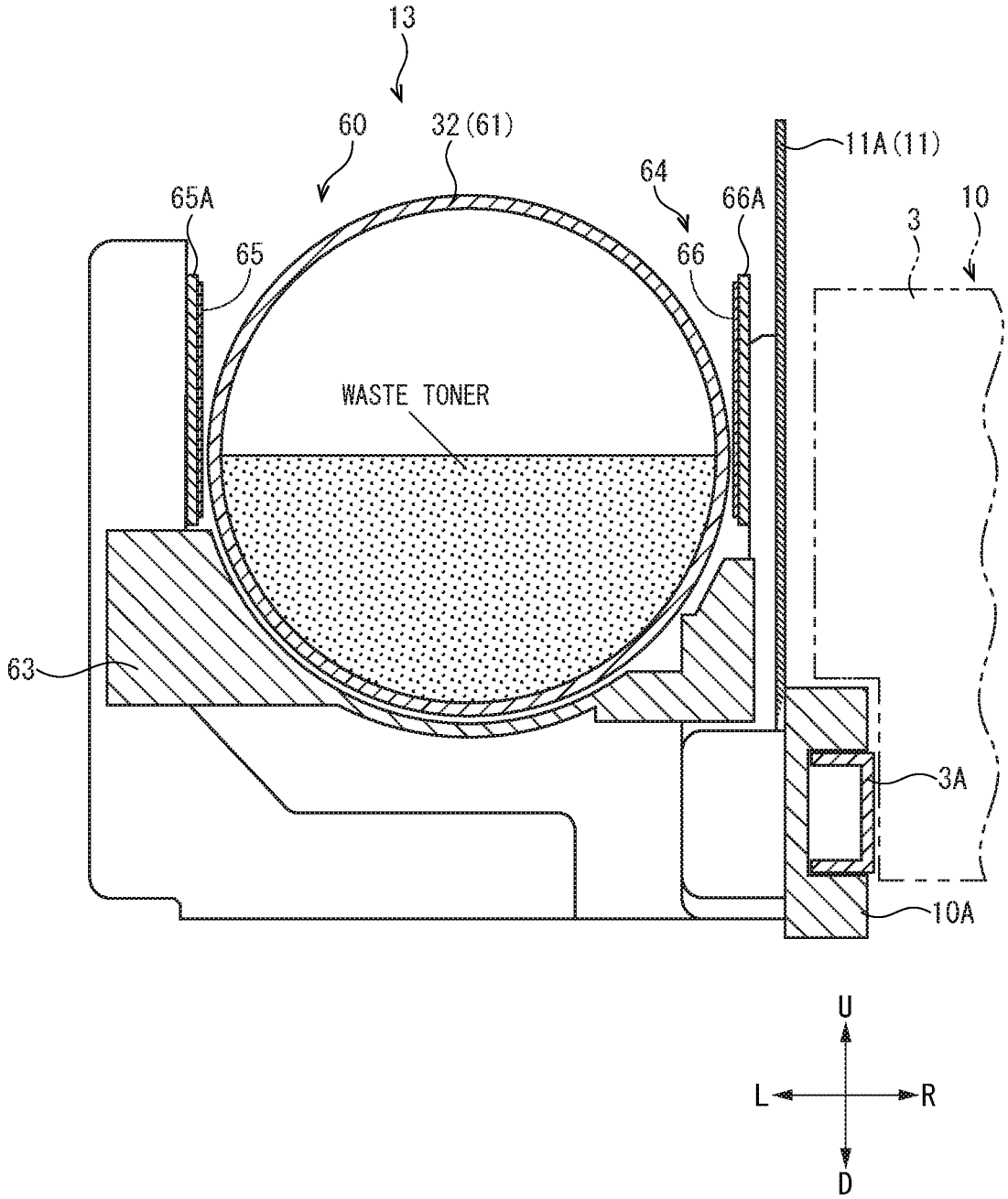
FIG. 8 is a sectional view taken along the line VIII-VIII in FIG. 2.

[the waste toner collection device] Next, with reference to FIG. 2 to FIG. 4, FIG. 7 and FIG. 8, the waste toner collection device 13 will be described. FIG. 8 is a sectional view taken along the line VIII-VIII in FIG. 2.

As shown in FIG. 2, the waste toner collection device 13 includes a collection side attachment part 60 and a collection bottle 61. To the collection side attachment part 60, the collection bottle 61 is detachably attached. The collection bottle 61 (the container main body 32) stores the waste toner discharged from the belt cleaning device 22 and the drum cleaning devices 27.

<The collection bottle> The collection bottle 61 as an example of a collection container is the empty toner bottle 31 in which the toner has been consumed (any one of the four toner bottles 31) (refer to FIG. 5). That is, the empty toner bottle 31 is used (reused) commonly as the collection bottle 61 in which the waste toner is collected. The collection bottle 61 has the same configuration as the toner bottle 31 described above, and its detail explanation is omitted. The reference numbers indicating the structure of the collection bottle 61 are the same as those indicating the structure of the toner bottle 31. The empty toner bottle 31 is used as the collection bottle 61, but not limited thereto, a special collection bottle 61 may be prepared separately from the toner bottle 31.

<The collection side attachment part> The collection side attachment part 60 is adjacently disposed on a left side of the cassette attachment part 10. The collection side attachment part 60 is disposed in a position corresponding to the conveyance discharge pipe 54 of the discharge conveyance device 18 (refer to FIG. 6 and FIG. 7). The collection side attachment part 60 has a space to which the collection bottle 61 is attached. On the lower portion of the front face of the apparatus main body 2, a front opening is formed, through which the collection bottle 61 is attached to the collection side attachment part 60.

The collection side attachment part 60 includes a collection cover 62, a support rail part 63 and a displacement sensor 64. The collection cover 62 is provided so as to open and close the front opening of the collection side attachment part 60. The support rail part 63 is provided so as to support the collection bottle 61 slidably. The displacement sensor 64 measures an electrostatic capacity in response to an amount of the waste toner stored in the collection bottle 61.

The collection cover 62 is provided so as to be turnable around a turning shaft provided in its lower portion. The support rail part 63 is provided in the lower portion in the collection side attachment part 60, and the upper face of the support rail part 63 is recessed along the circumferential face of the container main body 32. The support rail part 63 supports the container main body 32 so as to be slidable in the axial direction and rotatable around the axis.

[Attachment of the collection bottle] A process to attach the collection bottle 61 to the collection side attachment part 60 will be described. The user opens the collection cover 62 to expose the collection side attachment part 60 (the front opening), and then inserts the collection bottle 61 (the empty toner bottle 31) with the grip part G forward and the communication port 36 downward into the collection side attachment part 60. On a middle of the insertion of the collection bottle 61, the shutter comes into contact with a part of the collection side attachment part 60 and is relatively slid forward with respect to the collection side attachment part 60 to open the communication port 36. The opened communication port 36 is communicated with the downstream end of the conveyance discharge pipe 54 (refer to FIG. 7). Then, the user closes the collection cover 62.

In the above manner, the attachment of the collection bottle 61 is completed (refer to FIG. 2 and FIG. 4). In the state, the collection side attachment part 60 supports the cap 33 not rotatably and the container main body 32 rotatably. Additionally, in the state, the transmission gear 35 is coupled with the motor M (refer to FIG. 5) via the drive force transmission mechanism, and the communication port 36 is communicated with the cleaning devices 22 and 27 via the discharge conveyance device 18 (refer to FIG. 7).

[Removal of the waste toner] Next, a removal operation of the waste toner (the residual toner) will be described. The bias brush 46 and the screws 44, 49 and 51 are applied with a negative bias potential.

At the performing of the image forming operation, the polishing roller 41 and the regulation roller 42 are driven by the photosensitive drum 23 to be rotated, and the drum side screw 44 is driven by the motor (not shown) to be rotated. Alternatively, the polishing roller 41 and the regulation roller 42 may be driven by the motor to be rotated. On the surface of the polishing roller 41, the waste toner (the residual toner) remaining on the surface of the photosensitive drum 23 is adhered to form a toner layer. The polishing roller 41 polishes the surface of the photosensitive drum 23 through the toner layer. The regulation roller 42 regulates a thickness of the toner layer. The cleaning blade 43 scrapes the waste toner adhered on the surface of the photosensitive drum 23, and the scraped waste toner is collected in the drum side housing 40. The drum side screw 44 is driven by the motor to be rotated and conveys the waste toner stored in the drum side housing 40 toward the drum side discharge port 40A (refer to the arrow on FIG. 6). The waste toner is discharged through the drum side discharge port 40A, and enters the conveyance housing 50 through the drum side introduction pipe 52 (refer to the arrow in FIG. 7).

The bias brush 46, the collection roller 47 and the belt side screw 49 are driven by the motor to be rotated. The bias brush 46 attracts the waste toner (the residual toner) adhered on the surface of the intermediate transferring belt 21 with electrostatic attraction force. The collection roller 47 receives the waste toner transferred to the bias brush 46. The collection blade 48 scrapes the waste toner transferred on the collection roller 47, and the scraped waste toner is stored in the belt side housing 45. The belt side screw 49 is driven by the motor to be rotated and conveys the waste toner stored in the belt side housing 45 toward the belt side discharge port 45A (refer to the arrow in FIG. 6). The waste toner is discharged through the belt side discharge port 45A, and enters the conveyance housing 50 through the belt side introduction pipe 53 (refer to the arrow in FIG. 7).

The conveyance screw 51 is driven by the motor to be rotated and conveys the waste toner entered the conveyance housing 50 toward the conveyance discharge pipe 54 (refer to the arrow in FIG. 6). The waste toner entered the conveyance housing 50 is passed through the conveyance discharge pipe 54 and then enters the cap 33 (the collection bottle 61) through the communication port 36 (refer to the arrow in FIG. 7).

The container main body 32 (the conveyance rib 34) attached to the collection side attachment part 60 is driven by the drive motor M to be rotated around the axis (in an opposite direction to the rotational direction of the container main body 32 attached to the replenishment side attachment part 30). By rotating the container main body 32 (the conveyance rib 34) around the axis, the waste toner introduced in the container main body 32 through the communication port 36 is conveyed from the rear side to the front side (the other side in the axial direction). The conveyance rib 34 conveys the waste toner forward and also makes the surface (the upper face) of the stored waste toner flat.

As described above, the waste toner is collected in the collection bottle 61 (the container main body 32) (refer to FIG. 8).

(The displacement sensor) As shown in FIG. 2, FIG. 4 and FIG. 8, the collection side attachment part 60 is provided with the displacement sensor 64 which detects an accumulation amount (a storage amount) of the waste toner stored in the collection bottle 61. The displacement sensor 64 is an electrostatic capacity sensor disposed so as to face the collection bottle 61 and measuring an electrostatic capacity varied in response to an accumulation amount of the waste toner stored in the collection bottle 61. In detail, the displacement sensor is an electrostatic capacity sensor of a mutual electrostatic capacitive type which detects a variation in electric field between a transmission electrode 65 and a reception electrode 66 which are disposed so as to face each other on both sides of the collection bottle 61. The displacement sensor 64 can detect an accumulation amount of the waste toner to a capacity of the collection bottle 61 within a range from 0 to 100%, but is not limited thereto and the detectable accumulation amount may be set freely.

As shown in FIG. 4 and FIG. 8, the transmission electrode 65 and the reception electrode 66 are mounted on rectangular boards 65A and 66A long in the front-and-rear direction, respectively. The boards 65A and 66A are each provided in an upright posture along the front-and-rear direction, and fixed to a frame (not shown) of the collection side attachment part 60. The transmission electrode 65 and the reception electrode 66 (the boards 65A and 66A) are disposed above the support rail part 63. The transmission electrode 65 and the reception electrode 66 are disposed above the cassette rail 10A and the slide guide 3A. The transmission electrode 65 and the reception electrode 66 are formed on the surfaces of the boards 65A and 66A on a side of the container main body 32. The transmission electrode 65 is disposed on an opposite side to the cassette attachment part 10 (on a left side of the apparatus main body 2) with respect to the collection bottle 61. The reception electrode 66 is disposed on a side of the cassette attachment part 10 (the sheet feeding cassette 3). The transmission electrode 65 and the reception electrode 66 are electrically connected to the controller 17.

By the way, conventionally, an output (a detection result, an electrostatic capacity) of the electrostatic capacity sensor is varied in response to a distance between the transmission and the reception electrodes 65 and 66 and an object (a member) disposed its periphery. In the image forming apparatus 1, because the sheet feeding cassette 3 is closer to the collection side attachment part 60, and, for example, the output of the displacement sensor 64 may be varied in response to the attachment and detachment (the displacement) of the sheet feeding cassette 3. For example, although an accumulation amount of the waste toner in the collection bottle 61 is not varied, an electrostatic capacity measured by the displacement sensor 64 may be varied. That is, the displacement sensor 64 may detect an accumulation amount of the waste toner incorrectly. Then, the image forming apparatus 1 includes a structure which suppresses a variation of the output of the displacement sensor 64 in response to the displacement of the member, such as the sheet feeding cassette 3, disposed near the transmission and the reception electrodes 65 and 66.

The collection bottle 61, the transmission electrode 65 and the reception electrode 66 are disposed approximately in parallel with the holding main body 11A (the cassette rail 10A) of the rail holding member 11 along the axial direction (refer to FIG. 2). The transmission electrode 65 and the reception electrode 66 are disposed on a front side of the container main body 32 (the other side of the axial center in the axial direction) at a position not in contact with the container main body 32. The reception electrode 66 is disposed between the container main body 32 and the rail holding member 11 (the holding main body 11A) (when viewed from the front side). The reception electrode 66 (the board 66A) is disposed so as to face the holding main body 11A not in contact with the holding main body 11A. In detail, the front portion (a part) of the reception electrode 66 is overlapped with the non-movable holding main body 11A (refer to FIG. 4).

As an accumulation amount of the waste toner in the collection bottle 61 increases, an electric field (a capacity) between the transmission electrode 65 and the reception electrode 66 is varied. The controller 17 receives an output (a detection result) of the displacement sensor 64 periodically. An interval at which an output is received from the displacement sensor 64 (a sampling rate) can be set freely depending on a processing speed of the processer of the controller 17. The controller 17 calculates an accumulation amount of the waste toner in the collection bottle 61 based on the detection result. In the memory (not shown) of the controller 17, data corresponding to an electric capacity when the collection bottle 61 is filled up with the waste toner (the accumulation amount reaches a predetermined amount) is stored previously. When the detection result shows the filing up, the controller 17 stopes the image forming operation immediately.

Additionally, the controller 17 controls the touch panel or a speaker provided in the image forming apparatus 1 to report the user that the collection bottle 61 is filled up and to prompt him to replace the collection bottle 61.

When the collection bottle 61 filled up with the waste toner is replaced, the user grips the grip part G and pulls it forward to detach it from the collection side attachment part 60. As the collection bottle 61 is pulled forward, the shutter is biased rearward by the spring (not shown) to close the communication port 36.

In the image forming apparatus 1 according to the first embodiment as described above, the rail holding member 11 (the holding main body 11A mainly) covers the reception electrode 66 of the displacement sensor 64. In other words, the holding main body 11A of the rail holding member 11 is disposed so as to divide the reception electrode 66 from the cassette attachment part 10 (the sheet feeding cassette 3) (refer to FIG. 8). According to the configuration, even if the sheet feeding cassette 3 is attached and detached, a distance between the reception electrode 66 and the rail holding member 11 is kept constant so that a variation in electrostatic capacity measured by the displacement sensor 64 is suppressed and it becomes possible to measure an accurate electrostatic capacity. Thereby, even if the collection side attachment part 60 (the collection bottle 61) is disposed closer to the cassette attachment part 10 (the sheet feeding cassette 3), it becomes possible to detect an accumulation amount of the waste toner stored in the collection bottle 61 correctly without being affected by the attachment and detachment of the sheet feeding cassette 3.

In the image forming apparatus 1 according to the first embodiment, the transmission electrode 65 is disposed on an opposite side to the sheet feeding cassette 3 (the cassette attachment part 10) with respect to the collection bottle 61. According to the configuration, it becomes possible to dispose the transmission electrode 65 at a position that is hardly affected by the attachment and detachment of the sheet feeding cassette 3 and to cover the reception electrode 66 easily affected by the attachment and detachment of the sheet feeding cassette 3 with the rail holding member 11.

According to the image forming apparatus 1 according to the first embodiment, because the cylindrical container main body 32 is rotated around the axis, a distance between the displacement sensor 64 and the container main body 32 is not changed due to the rotation of the container main body 32, and it becomes possible to keep the distance constant. Thereby, the displacement sensor 64 can measure an accurate electrostatic capacity so that it becomes possible to detect an accumulation amount of the waste toner stored in the collection bottle 61 correctly.

In the image forming apparatus 1 according to the first embodiment, the front portion of the reception electrode 66 faces the rail holding member 11 (the holding main body 11A9, but not limited thereto, the rear portion or the whole of the reception electrode 66 may face the rail holding member 11 (the example is not shown). In the image forming apparatus 1 according to the first embodiment, the reception electrode 66 of the displacement sensor 64 is disposed so as to face the rail holding member 11, but the present disclosure is not limited to the embodiment. The reception electrode 66 may be replaced with the transmission electrode 65, and the transmission electrode 65 may be disposed so as to face the rail holding member 11 (the example is not shown). That is, the rail holding member 11 may be disposed so as to face at least a part of the displacement sensor 64.

Figure 9:
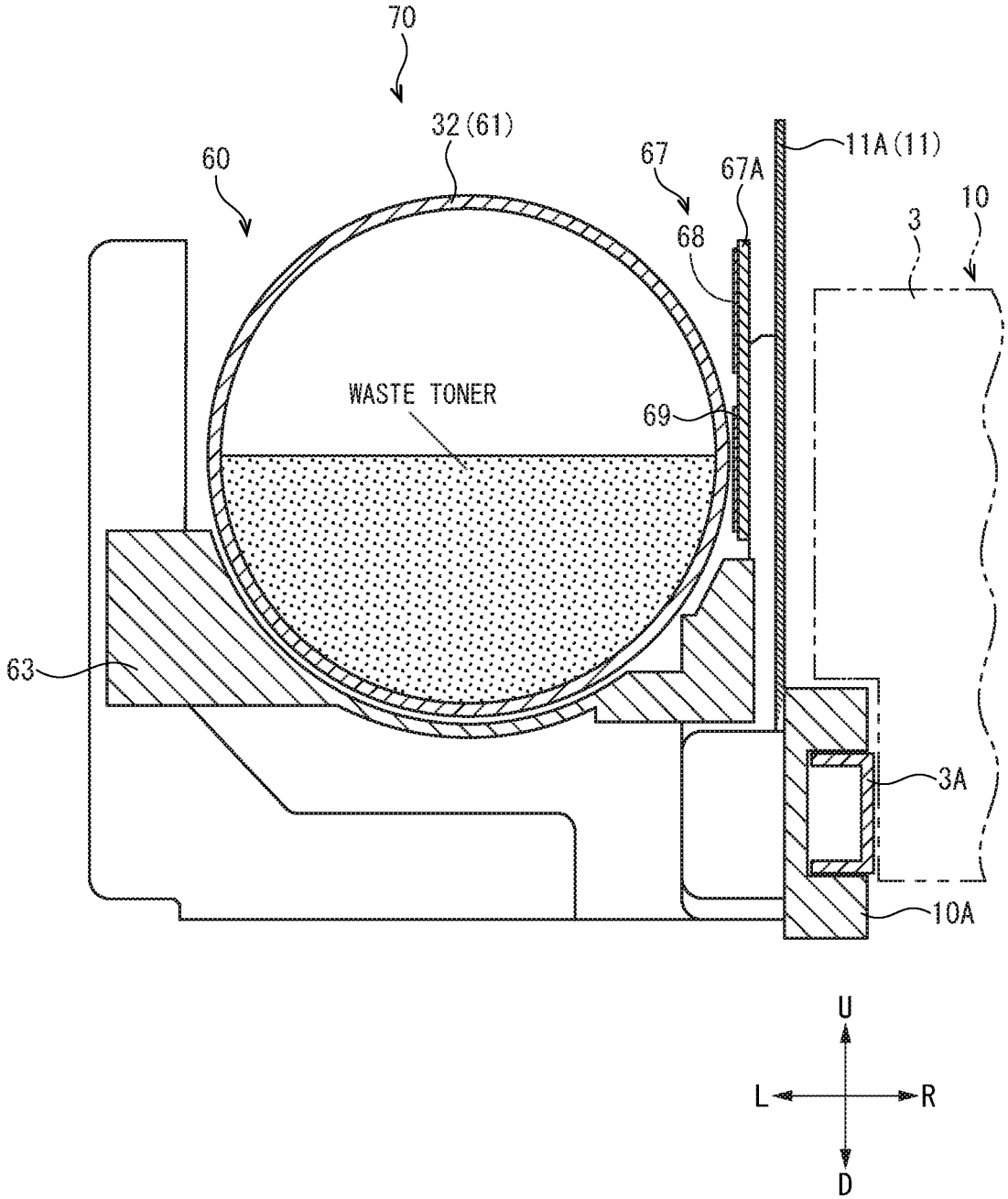
FIG. 9 is a sectional view (a front view) showing the waste toner collection device and the others in the image forming apparatus according to a second embodiment of the present disclosure.

[A second embodiment] Next, with reference to FIG. 9, the image forming apparatus 1 (the waste toner collection device 70) according to a second embodiment will be described. FIG. 9 is a sectional view (a front view) showing the waste toner collection device 70 and the others. In the following description, the same structure as the image forming apparatus 1 according to the first embodiment is marked with the same reference numbers, and the same or corresponding description is omitted.

In the waste toner collection device 70 according to the second embodiment, the transmission electrode 68 and the reception electrode 69 of the displacement sensor 67 are mounted on one board 67A side by side in the upper-and-lower direction. FIG. 9 shows an example where the transmission electrode 68 is disposed in the upper portion of the board 67A and the reception electrode 69 is disposed in the lower portion of the board 67A, but the transmission and the reception electrodes 68 and 69 may be disposed in reverse in the upper-and-lower direction. The displacement sensor 67 is an electrostatic capacity sensor of a mutual capacitive type that measures a variation in electric field between the transmission electrode 68 and the reception electrode 69 which are disposed between the collection bottle 61 and the rail holding member 11 (the holding main body 11A). The transmission electrode 68 and the reception electrode 69 are disposed so as to face the holding main body 11A not contact with the holding main body 11A. In detail, in the same manner as the above embodiment, the front portions (a part) of the transmission and the reception electrodes 68 and 69 are overlapped with the holding main body 11A.

According to the image forming apparatus 1 according to the second embodiment described above, even if the sheet feeding cassette 3 is attached and detached, it becomes possible to keep a distance between the transmission and the reception electrodes 68 and 69 and the rail holding member 11 constant and to suppress a variation in electrostatic capacity measured by the displacement sensor 67. Accordingly, the same function and effect as those of the image forming apparatus 1 according to the first embodiment can be obtained, for example, it becomes possible to detect an accumulation amount of the waste toner correctly without being affected by the attachment and detachment of the sheet feeding cassette 3.

In the waste toner collection device 70 according to the second embodiment, the front portions of the transmission and the reception electrodes 68 and 69 face the rail holding member 11 (the holding main body 11A), but not limited thereto, the rear portions of the transmission and the reception electrodes 68 and 69 or the wholes of the transmission and the reception electrode 68 and 69 may be disposed so as to face the rail holding member 11 (the example is not shown). The transmission electrode 68 or the reception electrode 69 may be disposed so as to face the rail holding member 11 (the example is not shown). The transmission electrode 68 and the reception electrode 69 may be mounted on the board 67A side by side in the left-and-right direction.

In the image forming apparatus 1 according to the first and the second embodiments (hereinafter, called "the present embodiment"), the container main body 32 of each of the toner bottle 31 and the collection bottle 61 is rotated around the axis to convey the toner (the replenishment toner, the waste toner) in the axial direction, but the present disclosure is not limited to the present embodiment. For example, as a modified example, the container main body may be a collection container in which a screw conveying the toner is stored (the example is not shown). In this case, the container main body is attached to the replenishment side attachment part 30 or the collection side attachment part 60 and the stored screw is rotated around an axis to convey the waste toner in the container main body in the axial direction. In such a collection container, it becomes possible to detect an accumulation amount of the waste toner correctly using the displacement sensors 64 and 67.

In the image forming apparatus 1 according to the present embodiment, the rail holding member 11 is formed into an L-shape on a plane, but the present disclosure is not limited to the present embodiment. For example, the rail holding member 11 may be formed into a simple plate-like shape, or into a box-like shape so as to cover at least either the transmission electrode 68 or the reception electrode 69 (the example is not shown). The rail holding member 11 is not necessary to be formed by a single member, and may be formed by combining some members (the example is not shown). That is, it may have any shape even if a function for holding the cassette rail 10A is satisfied. The rail holding member 11 may be made of synthetic resin, not limited to metal.

In the present embodiment, the waste toner collection devices 13 and 70 are controlled by the controller 17 provided in the image forming apparatus 1, but the present invention is not limited to the present embodiment. A controller provided separately from the controller 17 may be provided to control the waste toner collection devices 13 and 70 or the toner replenishment device 12 (the example is not shown).

In the image forming apparatus 1 according to the present embodiment, the displacement sensors 64 and 67 are not contact with the rail holding member 11 (the holding main body 11A), but the boards 65A, 66A and 67A may come into contact with the holding main body 11A (fixedly). In order to ensure the smooth rotation of the container main body 32, the displacement sensors 64 and 67 does not come into contact with the collection bottle 61, but they may come into contact with it.

In the description of the present embodiment, the present disclosure is applied to the image forming apparatus 1 (a color printer) as an example, but the present disclosure is not limited the embodiment, and may be applied to, for example, a monochrome printer, a copying machine, a facsimile or a multifunction peripheral.

The description of the above embodiments shows one aspect of the image forming apparatus according to the present disclosure, and the technical scope of the present disclosure is not limited to the above embodiments. The present disclosure may be varied, substituted, or modified without departing from the spirit of the technical idea, and the claims include all embodiments that may be included within the scope of the technical idea.

The invention claimed is:

1. An image forming apparatus performing an image formation by transferring a toner image on a sheet, the image forming apparatus comprising:

a cassette attachment part to which a sheet feeding cassette storing the sheet is detachably attached; and a collection side attachment part disposed adjacent to the cassette attachment part and to which a collection container storing a waste toner discharged without transferred on the sheet is detachably attached, wherein the cassette attachment part includes:

a cassette rail which supports the sheet feeding cassette slidably; and a rail holding member which holds the cassette rail, the collection side attachment part includes a displacement sensor which is disposed so as to face the collection container and detects an electrostatic capacity varying in response to an accumulation amount of the waste toner stored in the collection container, and the rail holding member is disposed so as to face at least a part of the displacement sensor.

2. The image forming apparatus according to claim 1, wherein the displacement sensor detects a variation in electric field between a transmission electrode and a reception electrode which are disposed so as to face each other across the collection container, and one of the transmission electrode and the reception electrode is disposed so as to face the rail holding member.

3. The image forming apparatus according to claim 2, wherein the transmission electrode is disposed on an opposite side to the cassette attachment part with respect to the collection container.

4. The image forming apparatus according to claim 1, wherein the displacement sensor detects a variation in electric field between a transmission electrode and a reception electrode which are disposed between the collection container and the rail holding member, and at least one of the transmission electrode and the reception electrode is disposed so as to face the rail holding member.

5. The image forming apparatus according to claim 4, wherein the transmission electrode and the reception electrode are mounted on a single board side by side in an upper-and-lower direction.

6. The image forming apparatus according to claim 1, wherein the collection container includes:

a cylindrical container main body having a spiral conveyance rib protruding inward in a radial direction from an outer circumferential face, and a cap which supports an end portion of the container main body on one side in an axial direction so as to be rotatable around the axis and has a communication port communicating with an inside of the container main body, the collection side attachment part supports the cap not rotatably and the container main body rotatably, when the container main body attached to the collection side attachment part is rotated around the axis, the waste toner introduced into the inside of the container main body through the communication port is conveyed toward the other side in the axial direction, and at least a part of the displacement sensor is disposed between the container main body and the rail holding member on the other side from an axial center of the container main body.

7. The image forming apparatus according to claim 6, wherein the reception electrode is disposed between the container main body and the rail holding member.

* * * * *